US007559315B1

(12) United States Patent
Yu et al.

(10) Patent No.: US 7,559,315 B1
(45) Date of Patent: Jul. 14, 2009

(54) REGENERATIVE FUEL PUMP

(75) Inventors: Dequan Yu, Ann Arbor, MI (US); Sheven Sharp, Troy, MI (US); Harold L. Castle, Dexter, MI (US); Stephen T. Kempfer, Canton, MI (US); Robert Joseph Pyle, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 12/029,394

(22) Filed: Feb. 11, 2008

(51) Int. Cl.
*F02M 37/20* (2006.01)
*F02M 37/22* (2006.01)

(52) U.S. Cl. ..... 123/516

(58) Field of Classification Search ..... 123/516, 123/509, 449, 450; 417/299, 307, 435, 423.1, 417/423.3; 415/55.1, 55.2–55.7, 169.1
See application file for complete search history.

(56) References Cited

U.S. PATENT DOCUMENTS 5,248,223 A * 9/1993 Hill ..... 415/55.3
5,336,045 A * 8/1994 Koyama et al. ..... 415/55.1
5,338,151 A 8/1994 Kemmner et al.
5,549,446 A * 8/1996 Gaston et al. ..... 415/55.1
5,662,455 A 9/1997 Iwata et al.
6,116,850 A 9/2000 Yu
6,238,191 B1 5/2001 Strohl et al.
6,283,704 B1 * 9/2001 Yoshioka ..... 415/55.1
6,547,515 B2 4/2003 Ross
2002/0090292 A1 * 7/2002 Ross ..... 415/55.1
2004/0258515 A1 * 12/2004 Honda et al. ..... 415/55.1

* cited by examiner

*Primary Examiner*—Mahmoud Gimie
(74) *Attorney, Agent, or Firm*—Julia Voutyras; Alleman Hall McCoy Russell & Tuttle LLP

(57) ABSTRACT

A rotodynamic fuel pump in a fuel delivery system for an internal combustion engine including a pump housing, a pump inlet channel extending through the housing allowing fuel to be drawn into the pump, a purge orifice extending through the housing and spaced away from the pump inlet channel, the purge orifice allowing fuel vapor to exit the pump, the purge orifice including a purge inlet, a purge outlet, and a purge channel, where the purge inlet is axially offset from the purge outlet.

19 Claims, 4 Drawing Sheets

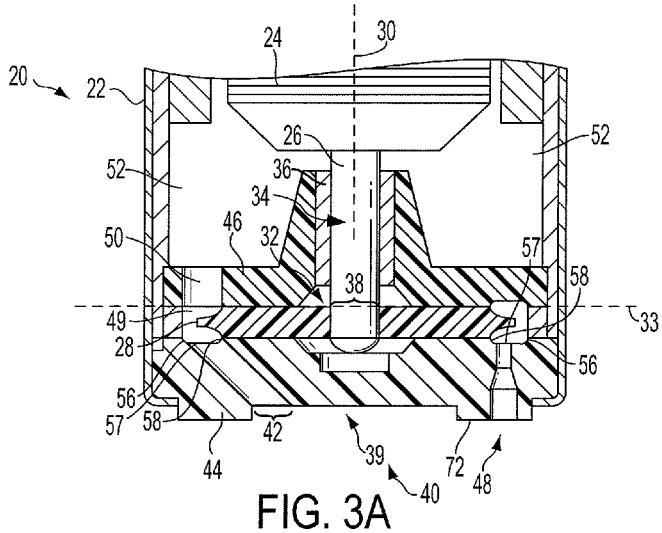
FIG. 3A
PRIOR ART
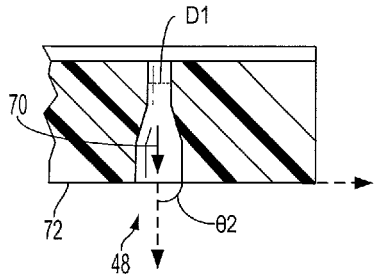
FIG. 3B
PRIOR ART
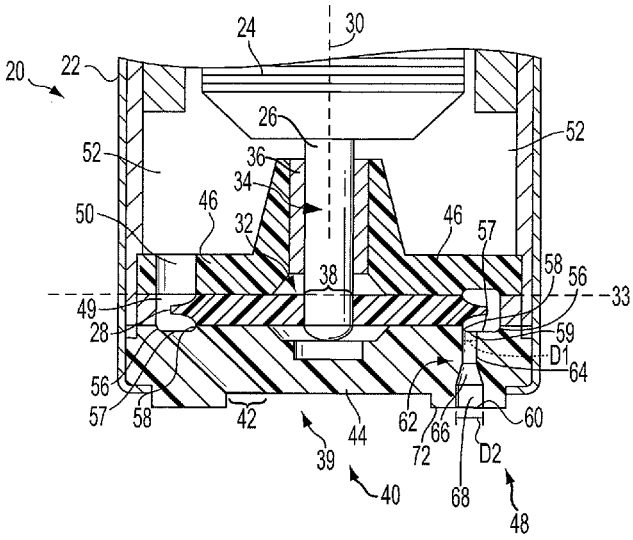
FIG. 4A
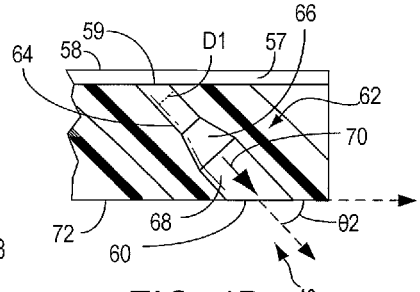
FIG. 4B
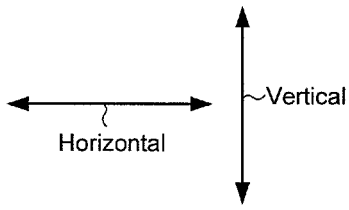

REGENERATIVE FUEL PUMP

BACKGROUND AND SUMMARY

Regenerative fuel pumps have been used in fuel delivery system for internal combustion engines due to their low cost, small size, and quiet operation. The regenerative fuel pump may be submerged in a fuel tank so the fuel pump can deliver sufficiently pressurized fuel to downstream components. For various reasons, the temperature of the fuel delivered to the regenerative pump may increase during operation of the engine. Due to the temperature rise fuel vapor bubbles may develop in the pump, reducing the pump flowrate, thereby decreasing the capacity and efficiency of the pump. In some cases, the flow may be decreased to the point where it may cause degradation in performance or cause the engine to stop. To address this issue, regenerative pumps may include a purge orifice allowing fuel vapor to be separated from the liquid fuel to thereby maintain pump efficiency.

Various types of purge orifices have been developed to decrease the amount of fuel vapor in the fuel. In particular the diameter of the purge orifice may be increased and the location of the purge orifice may be varied. In one approach, the purge orifice may be located further downstream of the pump inlet. One example is described in U.S. Pat. No. 5,284,417.

The inventors herein have recognized that during high flow conditions, increasing the size of the purge orifice and locating the purge orifice further downstream of the inlet may not increase the amount of fuel vapor that can be purged from the pump. Furthermore, when the size of the purge orifice is increased during high flow applications, the turbulence (i.e. flow interruption) in the pump may be increased as well, thereby decreasing pump efficiency. Thus, there may be a trade-off between an increased purge orifice size and/or orifice location to enable increased vapor separation on one hand, and the amount of flow interruption caused by the orifice on the other hand.

To address this apparent paradox, in one embodiment a rotodynamic (regenerative turbine) fuel pump in an internal combustion engine is provided. The rotodynamic fuel pump comprising a pump inlet extending through the lower housing allowing fuel to be drawn into the impeller chamber, a purge orifice including a purge inlet, a purge outlet, and a purge channel, extending through the lower pump housing allowing fuel vapor to be drawn out of the impeller chamber, and a purge outlet angle less than 90 degrees formed by the vertical flow direction through the purge outlet and the vertical plane defined by the side portion of the impeller.

In this way, it is possible to increase the vapor purging ability and limit the amount of flow interruption caused by the purge orifice without requiring substantial increases in the diameter of the purge orifice and/or movement of the purge orifice further downstream of the inlet. However, such actions may be taken in addition, if desired.

FIGURES

FIG. 1 Schematic depiction of the rotodynamic pump in fuel tank fluidly coupled to fuel rail, injectors and engine.

FIG. 3A shows a side view of a prior art purge orifice.

FIG. 3B shows another side view of a prior art purge orifice.

FIG. 4A shows a side view of the present disclosures purge orifice.

FIG. 4B shows another side view of the present disclosures purge orifice.

DETAILED DESCRIPTION OF FIGURES

Figure 1:
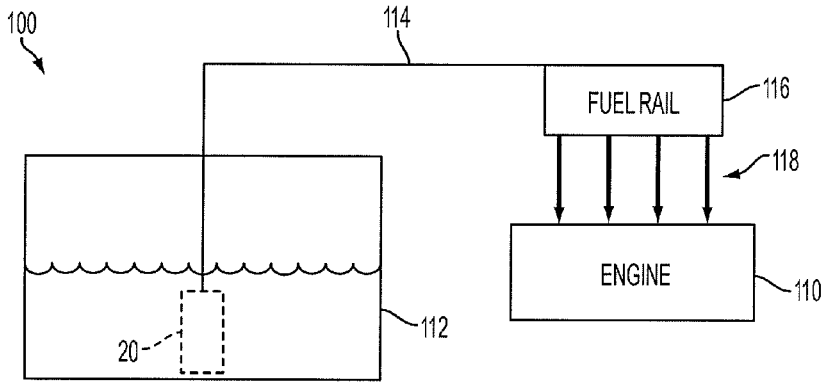

FIG. 1 shows a fuel delivery system 100 utilized in an internal combustion engine 110. The fuel delivery system may include rotodynamic pump 20 and a fuel tank 112 surrounding the rotodynamic pump 20. Rotodynamic pump 20 supplies fuel to various downstream components. The rotodynamic pump may be mounted vertically in the fuel tank. The fuel delivery system 100 may further include a fuel line 114 fluidly coupled to the pump extending out of the fuel tank 112 to a fuel rail 116. Fuel rail 116 is fluidly coupled to a series of fuel injectors 118. The fuel injectors at a given pressure deliver fuel at a given flowrate to cylinders (not shown) located in engine 110. Fuel injectors 118 may be port fuel injectors and/or direct fuel injectors. It can be appreciated by one skilled in the art that other variations of this fuel delivery system may be utilized to improve the performance of the fuel delivery system. In particular a second pump (not shown) may be coupled between rotodynamic pump 20 and fuel rail 116 to increase the amount and pressure of fuel that can be delivered to engine 110. Additionally, components such as a fuel filter (not shown), a pressure regulator (not shown), a fuel accumulator (not shown), a parallel pressure relief valve(s) (not shown), and/or a returnless fuel circuit (not shown) may be included to improve the efficiency and performance of the fuel delivery system.

Figure 2:
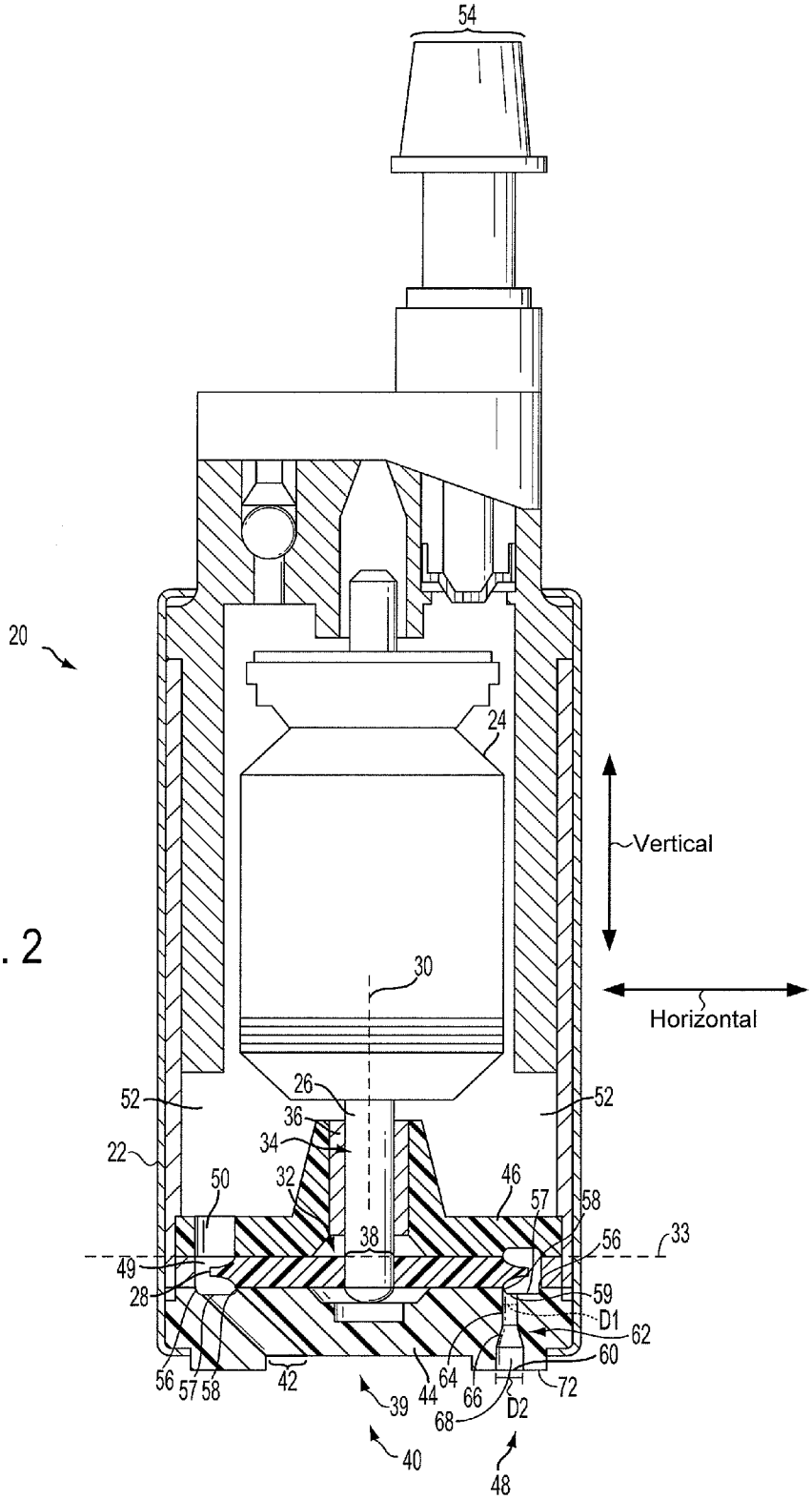
FIG. 2 shows a side view rotodynamic pump.

FIG. 2 shows rotodynamic pump 20. A vertical axis and a horizontal axis is shown in FIG. 2. A longitudinal axis extends into and out of the page. The rotodynamic pump may include a casing 22 that substantially surrounds an electrically driven motor 24. Various types of electronically driven motors may be used as motor 24, such as a brushed DC motor, a brushless DC motor, an AC motor, an induction motor, a stepper motor, etc. A shaft 26, driven by the electric motor 24, may be coupled to the electric motor, extending vertically out of the electric motor. A disk shaped impeller 28 may be rigidly coupled to shaft 26 through a vertical central axis 30. The impeller may have a side portion 32. The side portion may define a horizontal plane 33, perpendicular to the vertical central axis of the motor. A portion 34 of the shaft may be surrounded by a bearing 36, allowing the shaft to smoothly rotate in a fixed position. Shaft 26 extends through a shaft opening 38, into a lower portion 39 of the rotodynamic pump. In this way the electronic motor can actuate the rotating shaft and thereby rotate the impeller about the vertical central axis. The lower portion 39 of the pump may further include a pump inlet channel 42, a lower housing 44, an upper housing 46, and a purge orifice 48. The lower housing may surround at least a portion of the impeller and partially defines an impeller chamber. In this embodiment the purge orifice is spaced away from the pump inlet channel as shown in FIG. 6.

Pump inlet channel 42 allows fuel to be drawn into the rotodynamic pump 20 from fuel tank 112. The fuel may then travel into an impeller chamber 49. The impeller may be spun or rotated to propel fuel circumferentially outward to impeller chamber 49, increasing the energy of the fuel. Various impeller blade shapes may be used such as axial flow pitched blades or open radial vanes. Following the increase in energy of the fuel, the fluid may travel into an impeller outlet chamber 50.

From impeller outlet chamber the fuel may travel downstream into a downstream chamber 52 surrounding the electrically driven motor 24. In this way the electronically driven motor 24 may be cooled by the fuel traveling through the pump. From the downstream chamber 52 the fuel may then exit the pump through a pump outlet 54 shown in FIG. 2.

Figure 6:
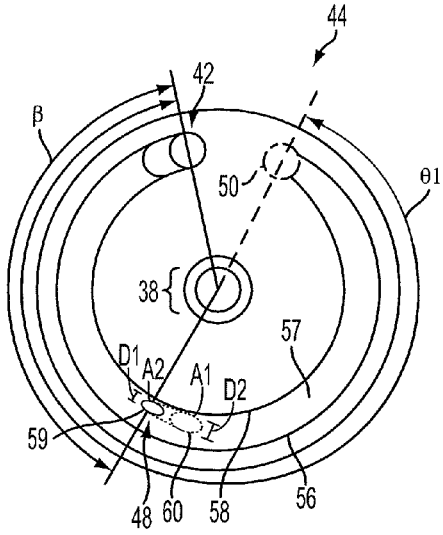
FIG. 6 shows an impeller side view of the lower housing.
Figure 7:
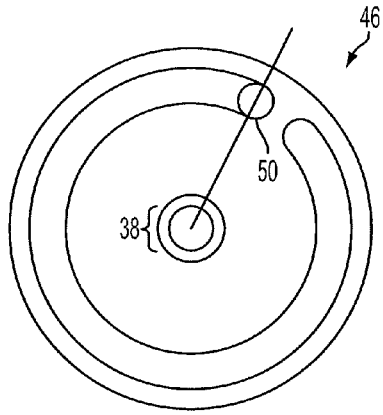
FIG. 7 shows an impeller side view of the upper housing. The figures are drawn approximately to scale.

FIG. 6 shows the impeller side view of the lower housing 44 with an annular channel 57, an first annular channel side wall 56 and a second annular channel side wall 58 that may extend circumferentially around the lower housing, adjacent to the impeller 28. As shown in FIG. 6, the purge orifice 48 may be located at an arc length β, downstream of the pump inlet channel 42, between the first annular channel side wall 56 and the second annular channel side wall 58, in annular channel 57. β extends circumferentially around the central axis and is the separation angle between the pump inlet and the purge orifice. The purge orifice allow vapor to be drawn out of the impeller chamber. A mixture of fluid and vapor may flow through the purge orifice. In one embodiment, the arc length β is approximately 130 degrees. However, in an alternate embodiment, the arc length β may be adjusted for different pump sizes, etc. The annular channel 57 may extend at an arc, θ1, circumferentially around lower housing 44. Arc length θ1 may be between 300 and 360 degrees depending on various system parameters. FIG. 7 shows an impeller side view of upper housing 46. The upper housing allows fuel to flow out of the impeller chamber 49 into impeller outlet chamber 50.

Figure 5A:
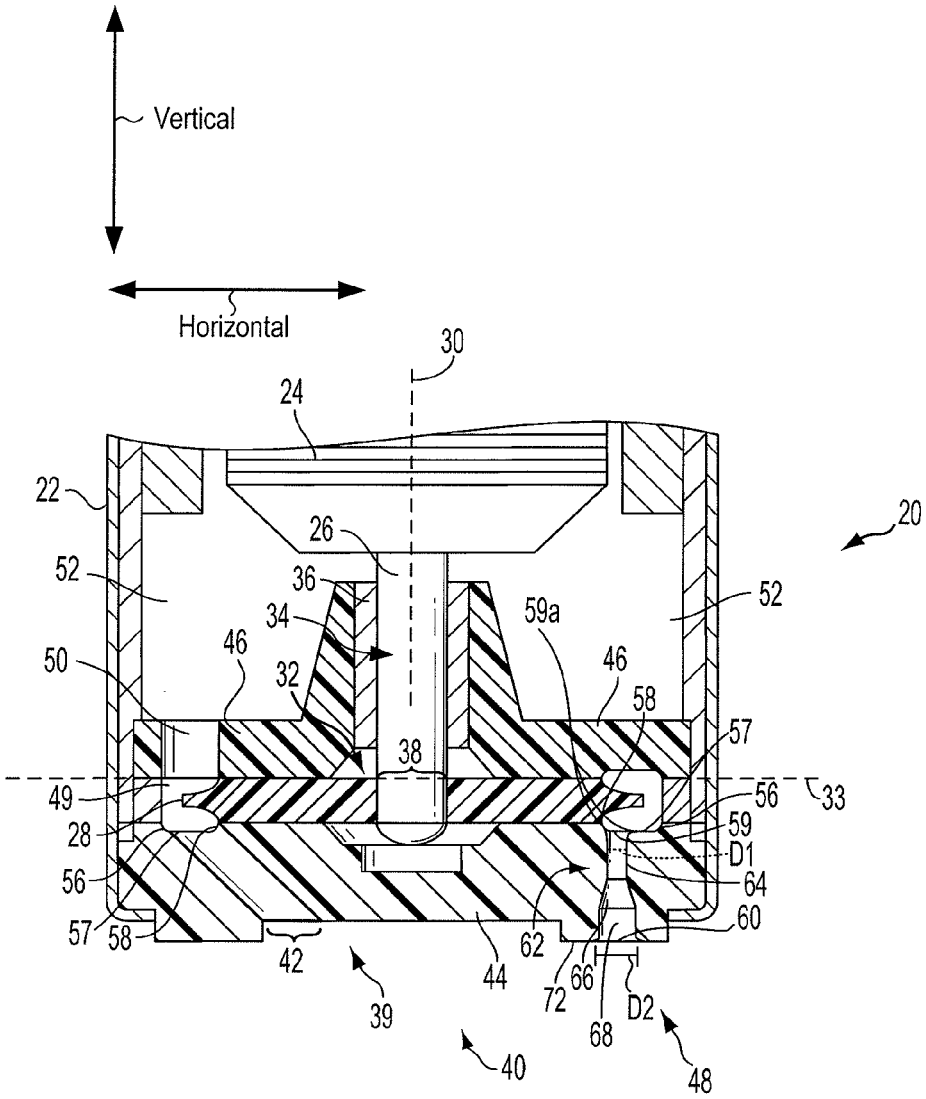
FIG. 5A shows a side view of an alternate embodiment of the purge orifice.
Figure 5B:
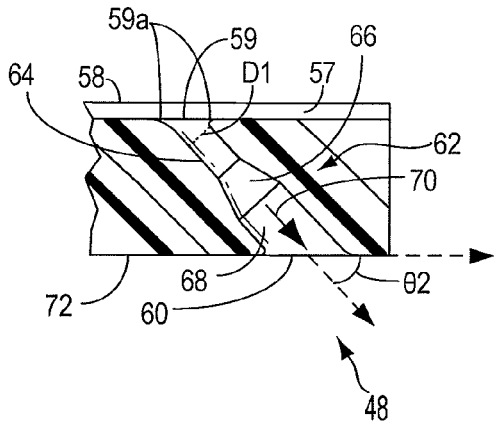
FIG. 5B shows another side view of the alternate embodiment of the purge orifice.

Referring now to FIG. 4A, the purge orifice 48 may have a purge inlet 59 with a minor diameter D1 and a purge outlet 60 with a minor diameter D2. The longitudinal axis extends into and out of the page. The purge orifice allows fuel vapor to be pushed out of the impeller and exit the pump. The purge orifice is spaced away from the pump inlet channel, allowing fuel vapor to exit the pump. The inlet minor diameter D1 is smaller than the outlet minor diameter D2. The purge inlet may be axially offset 61 from the purge outlet. A purge channel 62 may connect the purge inlet and purge outlet. The purge channel may decrease the velocity of the fuel vapor, allowing the vapor to exit the purge orifice at a reduced velocity, thereby decreasing the turbulence of the fluid around a purge outlet 60. The purge channel may further consist of an inlet portion 64 that extends through the lower housing 44 with an approximate diameter D1. The inlet portion may be adjacent to a conical portion 66. The conical portion may be downstream of the inlet portion. The diameter of the conical portion may gradually increase until it is approximately the size of the purge minor outlet diameter D2. The purge channel may further consist of an lower portion 68 or lower chamber, downstream of the conical portion, that extends through the housing at a purge outlet angle θ2, shown in FIG. 4B, allowing fluid to flow into the fuel tank. FIG. 4B shows another side view of the purge orifice. FIG. 4B shows a rotated view of the side view shown in FIG. 4A. Specifically, FIG. 4B shows a side view rotated 90 degrees counterclockwise about the vertical central axis 30, looking horizontally at a vertical plane extending longitudinally into and out of the page. In this way the purge outlet is angled longitudinally outwardly. In another example the purge outlet may be angled horizontally outwardly from vertical central axis 30. As shown in FIG. 4B, The purge orifice may extend through the housing at an angle θ2, relative lower side of the pump 72 and/or the horizontal plane 33 defined by the side of the impeller, creates an elliptical shape opening with an area A1 larger than the area A2, shown in FIG. 6. Area A2 determines the flow rate through the orifice and area A1 defines the vapor exit area. Now referring to FIG. 4B, the lower portion is adjacent to and includes the purge outlet. The conical portion may be closer to the purge inlet than the purge outlet. The purge outlet angle θ2 is the angle formed by the flow direction 70 through the purge outlet 60 and a horizontal plane 33 formed by the top portion 32 of the impeller and/or the lower side 72 of the pump. When the purge outlet angle θ2 is less than 90 degrees, the direction of the fluid is altered allowing the fluid in the purge orifice to be expelled from the purge outlet away from the pump inlet. Such action may decrease any interference from the pump inlet channel 42. In some examples, the purge outlet angle θ2 may be 45 degrees. In other examples, the purge outlet angle θ2 may be any angle less than 75 degrees. In still other examples, the purge outlet angle θ2 may be between 35 and 55 degrees. The surface of the purge channel may be constructed in such a way to reduce the resistance to the flow. In one example shown in FIG. 5A and FIG. 5B, the edge 59*a* of the purge inlet may be rounded. FIG. 5B shows a rotated view of the purge orifice shown in FIG. 5A. FIG. 5A is rotated 90 degrees about the vertical central axis 30, looking horizontally at the vertical plane extending into the page.

Additionally, the decreased purge outlet angle θ2 allows fluid to be expelled from the purge orifice away from the pump inlet channel at a greater distance than the purge orifice in the prior art, shown in FIG. 3A and FIG. 3B, further decreasing the interference from the fuel tank. The improved geometry increases the distance traveled by the fluid which further decreases the speed of the fluid, minimizing the interference in the fuel tank.

In some examples, as noted herein, it may be desirable to increase the amount of fuel vapor traveling through purge orifice 48 when the pump is being driven at full power. During operation of the rotodynamic pump, turbulence may be generated in fuel surrounding the bottom portion 40 of the rotodynamic pump. The turbulence may decrease the amount of fuel vapor that can be release from the purge orifice 48, decreasing the efficiency of the pump and the engine. In prior art solutions, as shown in FIG. 3A and FIG. 3B, the outlet angle θ2 is approximately 90 degrees. FIG. 3B shows a rotated view of the purge orifice shown in FIG. 3A. FIG. 3A is rotated 90 degrees about vertical central axis 30, looking horizontally at the vertical plane extending into the page. When the vapor is purged at this angle through the purge outlet, the flowrate of the fuel vapor may significantly decrease due to the turbulence in the fuel. The present disclosure has recognized, however, that when θ2 is less than 90 degrees, for example between 35 and 55 degrees, or specifically 45 degrees, the amount of vapor that can be removed from the fuel is substantially increased while at the same time the disturbance or turbulence in the impeller chamber is decreased. Thus, the efficiency of the pump is increased.

Furthermore, the size of the pump can be correlated with the purge outlet angle θ2 and the outlet diameter D2. For example, when the rotodynamic pump is rated at 200 liters per hour, the purge outlet angle θ2 used to increase pump efficiency may be approximately 45 degrees and the minor outlet diameter D2 may be approximately 1.2 millimeters. In alternate embodiments, the specific diameters and purge outlet angle may be altered to account for the composition of the fuel. For example, if a more viscous diesel fuel is used and stored in the fuel tank, the minor outlet diameter D2 may be slightly increased and the purge outlet angle θ2 may be slightly decreased, and vice versa.

Other strategies employed to increase the amount of vapor that can be purged from the fuel pump may include rounding the edges of the of the purge outlet and/or purge inlet as shown in FIG. 5A and FIG. 5B. The shape of the annular passages in the lower housing may be altered as well to reduce the turbulence created by the purge inlet. Still further modifications or additional approaches may also be used in combination with the angle purge outlet.

With regard to the manufacture of the pump, the lower housing 44 may first be molded. Then, the purge orifice 48, the pump inlet channel 42, and annular channel 57 may be machined in the lower housing 44. Alternatively, the lower housing may be integrally molded to include purge orifice 48, pump inlet channel 42, and annular channel 57. In one example, the lower housing may integrally molded creating smoother flow channels, decreasing the resistance to flow. The lower housing may be formed out of plastic, aluminum, or steel alloy depending on the requirement of the fuel delivery system.

It will be appreciated that the configurations disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and nonobvious combinations and subcombinations of the various systems and configurations, and other features, functions, and/or properties disclosed herein.

The following claims particularly point out certain combinations and subcombinations regarded as novel and nonobvious. These claims may refer to "an" element or "a first" element or the equivalent thereof. Such claims should be understood to include incorporation of one or more such elements, neither requiring nor excluding two or more such elements. Other combinations and subcombinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A rotodynamic fuel pump in a fuel delivery system for an internal combustion engine comprising:

a pump housing;

a pump inlet channel extending through the housing allowing fuel to be drawn into the pump; and a purge orifice extending through the housing and spaced away from the pump inlet channel, the purge orifice allowing fuel vapor to exit the pump, the purge orifice including a purge inlet, a purge outlet, and a purge channel, where the purge inlet is axially offset from the purge outlet.

2. The pump of claim 1 further comprising an impeller coupled to the motor, where a side of the impeller defines a horizontal plane perpendicular to an axis of the motor, and where at least a portion of the purge channel is formed at an angle less than 90 degrees relative to the horizontal plane.

3. The pump of claim 2 where the angle is less than 90 degrees.

4. The pump of claim 3 where the angle is between 34 and 55 degrees.

5. The pump of claim 4 where the angle is 45 degrees with respect to the horizontal plane and 45 degrees with respect to the axis of the motor.

6. The pump of claim 5 where the channel includes a conical portion to expand a diameter of the channel from a smaller inlet diameter to a larger outlet diameter.

7. The pump of claim 6 where the conical portion of the purge channel is closer to the purge outlet than to the purge inlet.

8. The pump of claim 7 where the lower portion of the purge channel is adjacent to and includes the purge outlet.

9. The pump of claim 8 where the conical portion of the purge channel is upstream of the lower portion of the purge channel, and spaced away from the purge inlet, and where the purge outlet angle is angled horizontally outward from a vertical axis of the pump.

10. The pump of claim 8 where the purge outlet angle is angled longitudinally outwardly.

11. A rotodynamic fuel pump in a fuel delivery system for an internal combustion engine comprising:

a motor;

an impeller including a side portion defining a horizontal plane, the impeller coupled to the motor and rotating about a vertical axis;

a lower housing surrounding at least a portion of the impeller and partially defining an impeller chamber;

a pump inlet extending through the lower housing allowing fuel to be drawn into the impeller chamber; and a purge orifice including a purge inlet, a purge outlet, and a purge channel, the channel extending through the lower pump housing allowing fuel vapor to be pushed out of the impeller chamber, where an angle less than 90 degrees is formed between the purge channel and the horizontal plane, and where the purge channel is continuously angled from the purge inlet to the purge outlet with the purge channel extending through the housing at the angle.

12. The rotodynamic fuel pump of claim 11 wherein the impeller is disk shaped, and where the pump is mounted vertically in a fuel tank, and where the angle is angled horizontally outwardly from a vertical axis of the pump.

13. The rotodynamic fuel pump of claim 11 wherein the angle is formed by a lower chamber relative to the vertical axis, where the angled chamber is angled at approximately 45 degrees, and where the opening of the purge outlet into a fuel tank at the 45 degree angle creates an elliptical shape opening, and where the purge inlet further creates and elliptical shape opening.

14. The rotodynamic fuel pump of claim 13 wherein the purge orifice is separated from the pump inlet channel by 130 degrees circumferentially around the vertical axis.

15. The rotodynamic fuel pump of claim 11 wherein the purge inlet is approximately 1.2 millimeters in diameter and the pump capacity is greater than 200 liters per hour, and where the angle is angled longitudinally outwardly.

16. The rotodynamic fuel pump of claim 11 wherein the purge inlet is rounded.

17. The rotodynamic fuel pump of claim 11 wherein the lower housing is integrally molded to form the purge orifice and the pump inlet.

18. A method of pressurizing fuel via a pump in a fuel system of an engine, comprising:

drawing in fuel through an inlet to the pump on a side of the pump;

spinning an impeller to pump the fuel; and expelling vapor through an orifice in the side of the pump at an angle less than 90 degrees, relative to the side of the pump.

19. The method of claim 18 wherein the vapor is expelled at approximately a 45 degree angle relative to the side of the pump.

* * * * *